United States Patent [19]

Stowik et al.

[11] 4,180,944

[45] Jan. 1, 1980

[54] DOOR JAMB ASSEMBLY

[75] Inventors: William J. Stowik, Hudson; Kenneth L. Kaiser, North Hudson, both of Wis.

[73] Assignee: The Vollrath Company, Sheboygan, Wis.

[21] Appl. No.: 956,359

[22] Filed: Nov. 3, 1978

[51] Int. Cl.[2] ..... E06B 1/04

[52] U.S. Cl. ..... 49/504; 49/70; 49/380

[58] Field of Search ..... 49/70, 380, 504, 502, 49/399–401

[56] References Cited

U.S. PATENT DOCUMENTS

| | | | |
|---|---|---|---|
| 2,922,202 | 1/1960 | Kodaras | 49/401 |
| 2,930,480 | 3/1960 | Brown | 49/380 X |
| 2,978,755 | 4/1961 | Walker | 49/401 |
| 3,120,295 | 2/1964 | Lemmerman | 49/401 |
| 3,218,678 | 11/1965 | Russell | 49/401 X |
| 4,004,370 | 1/1977 | Heaney | 49/504 X |

*Primary Examiner*—Kenneth Downey

*Attorney, Agent, or Firm*—Dressler, Goldsmith, Clement, Gordon & Shore, Ltd.

[57] ABSTRACT

A novel door jamb made of a plurality of sections which are maintained together in a rigid, dimensionally stable frame by strap means disposed around the door jamb members. The strap means are disposed around the inner surfaces of the jamb members which have a generally T-shaped configuration. The strap means are located within the jamb between the fiberglass matter making up the major portion of the jamb assembly and the sidewalls of the jamb.

4 Claims, 2 Drawing Figures

DOOR JAMB ASSEMBLY

BACKGROUND OF THE INVENTION

Door jambs heretofore used with low-temperature compartments, such as, freezers, have typically been made of metallic materials the use of which gives rise to a number of disadvantages. To overcome the tendency of metallic door jambs to rust and corrode, as well as to counter the high thermal conductivity of metals, U.S. Pat. No. 4,080,764 teaches the advantages of having the exterior surface of the door jamb constructed of reinforced fiberglass material.

The use of a reinforced fiberglass material for the exterior surface of the door jamb, due to its low thermal conductivity, requires only a heater wire strip isolated by the door jamb from the metallic portion of the cooler or freezer which consumes electric power on the order of 2 watts per foot, as compared with 10 watts per foot, when one uses a metal door jamb. Increasing the insulation of the heater strip from the metallic portion of the freezer permits even further reduction of power required to maintain the door gaskets used with the doors in a good sealing relationship and prevents condensation from forming around the perimeter of the door opening.

The present invention relates to an improved door jamb having a reinforced fiberglass exterior surface which has increased rigidity and strength, requires less power to operate and is economically assembled into a rigid, dimensionally stable frame prior to installation in a cooler or freezer department.

Prior to the attachment of sidewalls and addition of insulating material, such as, rigid polyurethane foam, the door jamb consists of separate, elongated members which are cut to a particular desired size corresponding to the door opening of the freezer. In the assembly of these door jamb members into a rigid, dimensionally stable frame, no adhesive or glue can be used. There is no known adhesive, glue, hot melt, or bonding process available that can effectively bond the fiberglass jamb members at their corner junctures due to the extremes of temperatures to be encountered. The use of screws or hinges is not desirable because their use requires insertion into the solid fiberglass structure increasing the possibility of air leakage. To economically assemble the jamb members into a rigid frame, the present invention utilizes metallic bands strapped about the interior surfaces of the fiberglass door jamb members. The metallic bonds completely surround the jamb members and when tightened into place, secure all corners of the door jamb making a rigid, dimensionally stable, door jamb assembly.

A further feature of the present invention is the addition of two-sided adhesive tape along the edge of the heater wire channel to help secure the side of the channel within the fiberglass material and prevent any possibility of air leakage with the consequence of condensation forming on the door jamb as the colder surface contacts the warmer air outside the freezer. The greater insulation provided by this feature reduces the power required of the heater wire.

Other advantages will be apparent from the following description of a preferred embodiment of the invention, as illustrated in the attached drawings, in which:

FIG. 1 is a perspective view of a door jamb showing a door in an open position; and FIG. 2 is a cross-sectional view of the door jamb taken along line 2—2 of FIG. 1.

DETAILED DESCRIPTION OF THE DRAWINGS

Figure 1:
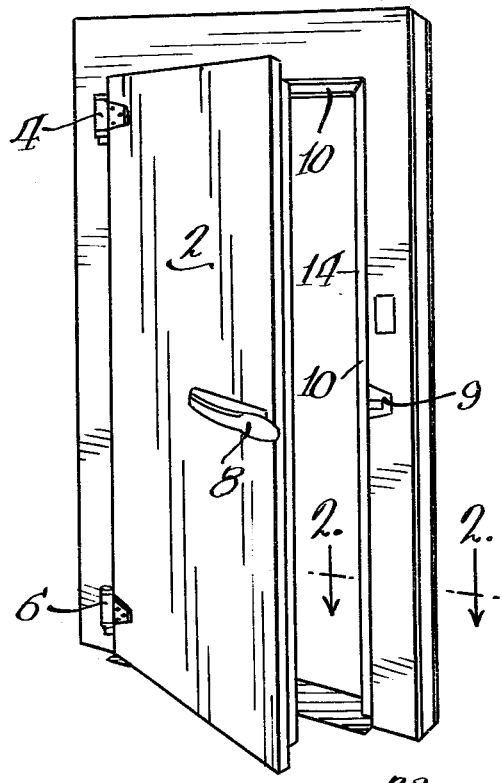

Referring now to FIG. 1, it is seen that there is illustrated a door 2 shown in the open position and hinged to a door jamb by hinges 4, 6. The door is moved relative to the door jamb by a handle 8 which is positioned to be engaged with a latch 9 secured to the door jamb member 10 by tapping plate 11. Door jamb members 10 are preferably elongated and demountably attached to each other.

Figure 2:
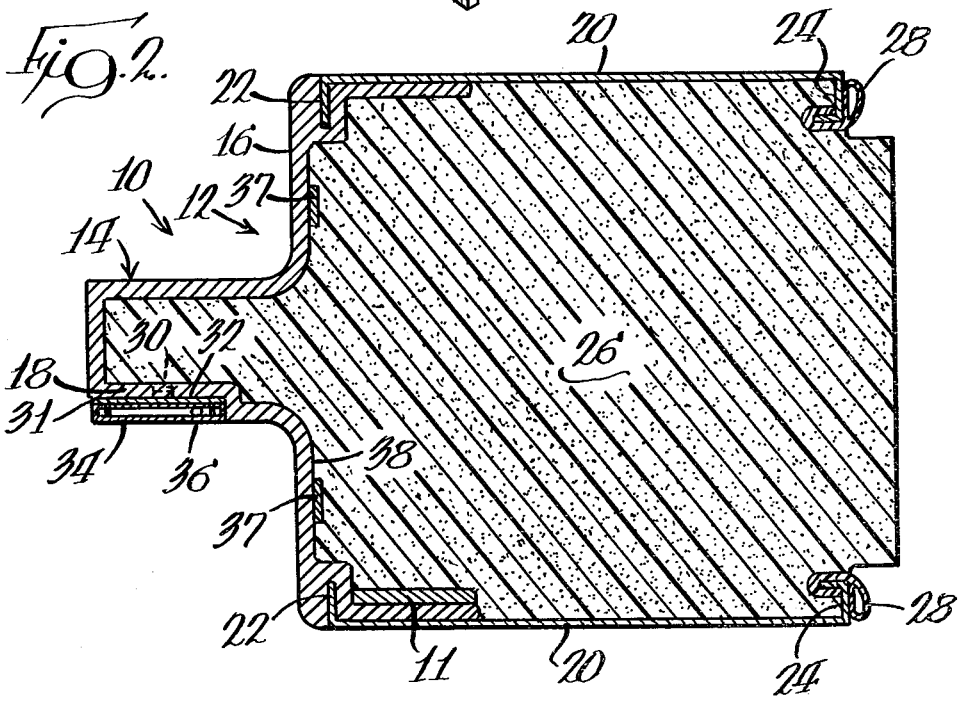

The cross-sectional view of each door jamb member 10, as shown in FIG. 2, is generally T-shaped in configuration and includes a front portion 12 made up of leg 14 and sidewalls 16 disposed on opposite sides of the leg 14. The front portion 12 is constructed of a fiberglass material.

The remainder of each door jamb member 10 consists of sidewalls 20 having flanges 22 and 24 extending inwardly, which sidewalls are constructed of an appropriate material, and a fiberglass cap 12. Contained within the sidewalls and cap is an insulating material 26, such as, a rigid polyurethane foam. At the back end of the door jamb members are gaskets 28, which aid in providing a sealing relationship to minimize leakage when the door jamb assembly is inserted into position.

It is necessary to provide a heater assembly in that portion of the door jamb member to be contacted by the door sealing gasket in order to insure that the gasket will be maintained sufficiently pliable to perform the necessary sealing function when door 2 is closed. To this end, there is employed a heater strip which is secured to the fiberglass jamb portion, which heater strip is thereby isolated from the interior of the cooler, or freezer, and the other surrounding area by attaching it to the fiberglass material 12, which has a very low thermal conductivity. Thus, the heat source will remain localized and not have the disadvantages referred to above. Specifically, the isolated heat strip assembly, as shown in FIG. 2, is secured to the wall 18 of the leg 14 by rivets 30 and two-sided adhesive tape 31 and consists of a pair of interengaging channel members 32, 34. The channel member 34 is designed to slide relative to the channel member 32 to permit relative movement therebetween and thus facilitate insertion of heater wire 36, which is connected to a suitable source of power to conduct heat to the heater strip assembly to insure that the sealing gasket to the door 2 will remain pliable and thus serve to eliminate any chance of frost buildup on the jamb due to outside air leakage. Adhesive tape 31, in addition to securing the isolated heat strip assembly to the fiberglass surface, also prevents the possibility of air leakage through rivets 30 and consequent condensation.

Prior to the addition of sidewalls 16 and insulating material 26, door jamb members 10 are separated from each other. In accordance with the present invention, metallic strap bands 37 of the type commonly used to strap shipping cartons surround the interior surface 38 of the fiberglass front portion 12 of door jamb members 10 and, then tightened into place, secures all jamb members 10 to each other making a rigid, dimensionally stable, door jamb frame assembly to which can be added sidewalls 20 and insulating material 26.

It is intended to cover by the appended claims all such modifications as fall within the true spirit and scope of the invention.

We claim:

1. A jamb assembly for a door having a sealing gasket closing off a sealed low temperature compartment comprising a plurality of elongated door jamb members, each of said jamb members having a generally T-shaped configuration in which a leg of said jamb and its adjacent surfaces are constructed of a reinforced fiberglass material and the majority of the balance thereof is a foam material, said jamb leg including an exposed surface positioned to be contacted by the door in its closed position, the assembly further includes an isolated heat strip assembly consisting of a metallic enclosure disposed within the recess of said exposed surface with the outer surface of said enclosure being flush with the exposed surface of said leg, means securing said metallic enclosure to said leg, a heater wire requiring very low wattage extending through said enclosure, said heater wire serving to aid in maintaining the sealing relationship between the door and jamb assembly and at the same time to eliminate any chance of frost buildup on the jamb due to outside air leakage, and strap means for maintaining said door jamb members in a rigid, dimensionally stable frame, which strap means are disposed around the inner surfaces of said fiberglass material.

2. A door jamb as claimed in claim 1 wherein said strap means comprises a pair of elongated, metallic bands strapped around the inner surfaces of said leg adjacent surfaces on opposite sides of said legs of each of said jamb members.

3. A door jamb as claimed in claim 1 wherein said securing means includes a two-sided adhesive tape taped to the adjacent surfaces of said metallic enclosure and jamb leg.

4. A door jamb as claimed in claim 1 including a metallic tapping place disposed therewithin to facilitate securing a latch to said door jamb member.

* * * * *